United States Patent [19]

De Suarez D'Aulan

[11] Patent Number: 4,966,091

[45] Date of Patent: Oct. 30, 1990

[54] SYSTEM FOR MOUNTING ACCESSORIES ON INFLATABLE STRUCTURES SUCH AS BOATS

[76] Inventor: Henri F. L. H. De Suarez D'Aulan, 101 rue du Bac, 75007, Paris, France

[21] Appl. No.: 213,053

[22] Filed: Jun. 29, 1988

[30] Foreign Application Priority Data

Jul. 3, 1987 [FR] France ..... 87 09502

[51] Int. Cl.[5] ..... B63B 7/00

[52] U.S. Cl. ..... 114/345; 441/40; 24/522

[58] Field of Search ..... 114/61, 343, 345, 346, 114/364; 441/40–42; 24/522, 527, 529, 532

[56] References Cited

U.S. PATENT DOCUMENTS 1,749,711 3/1930 Meyer ..... 441/40
3,168,751 2/1965 Cavaignac et al. ..... 114/345
4,348,971 9/1982 Montgomery ..... 114/61
4,660,497 4/1987 Cochran ..... 441/40

FOREIGN PATENT DOCUMENTS 3231550 3/1984 Fed. Rep. of Germany ..... 441/40

*Primary Examiner*—Joseph F. Peters, Jr.
*Assistant Examiner*—Jesus D. Sotelo
*Attorney, Agent, or Firm*—Saidman, Sterne, Kessler & Goldstein

[57] ABSTRACT

The invention provides a system for mounting accessories on inflatable structures. The system according to the invention is characterized by having a profiled molding (2) forming a strip adapted to be secured to the inflatable structure (1), and selectively removable and position-adjustable mounting devices (4) for mounting of accessories or accessory-fittings on said profiled molding (2). The invention is suitable for use on inflatable boats.

7 Claims, 2 Drawing Sheets

SYSTEM FOR MOUNTING ACCESSORIES ON INFLATABLE STRUCTURES SUCH AS BOATS

The present invention concerns a system for mounting accessories, such as lifting rings, grips and rain-awnings, on inflatable structures such as rubber boats.

Up to the present mounting of accessories, particularly on rubber boats, has been accomplished by bonding. This method of mounting has the major inconvenience of being irreversible.

The object of the present invention is to overcome the inconvenience of the known method of mounting.

To achieve this object, the mounting system according to the present invention is characterized by having a profiled molding forming a strip adapted to be secured to the inflatable structure and selectively removable and position-adjustable mounting devices for mounting of accessories or accessory-fittings on the profiled molding.

According to a preferred aspect of the invention, the profiled molding is made of a pliable material such as neoprene.

According to another preferred aspect of the invention, the molding forms a slide-bar and includes a T-shaped groove; a detachable accessory-mounting device includes a part forming an anchor-member, adapted to engage, and be retained by, the groove; an outer member forming an accessory-fitting or being part of the accessory, which is adapted to fit onto the outer surface of the molding on both sides of the groove; and means of removably attaching the outer member to the part forming the anchor-member, by locking the two members onto the molding.

According to another preferred aspect of the invention, the means forming the slide-bar consist of at least one T-shaped rib and a detachable accessory-mounting device comprising an accessory-fitting member, or a member that is part of the accessory, in the form of a anchor-block fitting onto said rib and which can be removably mounted onto same by securing means preferably of the nut and bolt type.

According to another preferred aspect of the invention, the member forming the anchor-block is composed of two parts each of which is adapted to engage the rib on one side thereof and which can be assembled while engaging the rib using appropriate securing means, such as threaded bolts with nuts.

The invention will be better understood, and other purposes, aspects, details and advantages thereof will become clearer in the course of the explanatory description which follows, in which reference is made to the attached schematic drawings given as examples illustrating some embodiments of the invention, and in which.

Figures 1, 2, 3:
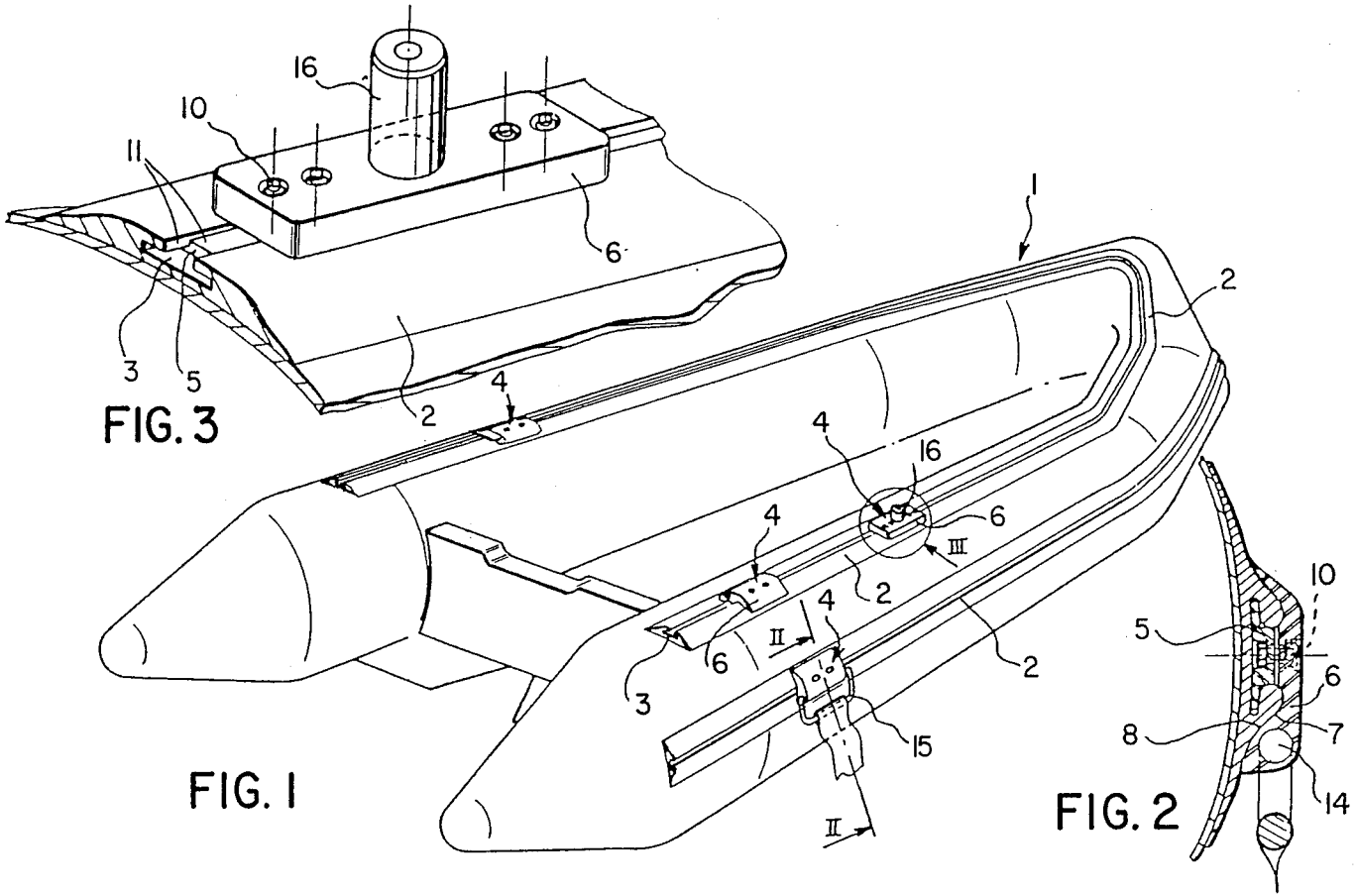
FIG. 1 is a perspective view of an inflatable rubber boat provided with an accessory-mounting system according to the present invention.
FIG. 2 is a cross-section following line II-II in FIG. 1, with cutaway.

FIG. 3 is a blow-up with cutaway of the part surrounded by the circle III in FIG. 1; and FIGS. 4*a* and 4*b* to 8*a* and 8*b* show several embodiments of a mounting system according to the invention, where 4*a* to 8*a* show the moldings, and 4*b* to 8*b* show the detachable mounting members associated with the profiles shown in 4*a* to 8*a*.

FIG. 1 shows an inflatable rubber boat 1 provided with an accessory-mounting system according to the invention. These accessories may be lifting rings, front grips, rain-awnings, seats, oarlocks and the like. Such a mounting system includes one or more profiled moldings 2 in the form of a slide-bar and forming a strip, preferably of flexible material such as neoprene. These profiled moldings may be secured, for example, by bonding to the floats of the boat. In the figure, the moldings 2 are disposed in a horizontal and a vertical orientation, respectively. It is understood that these moldings could be disposed elsewhere if desired.

As illustrated in greater detail in FIGS. 2 and 3, the profiled molding 2 profiled in the form of a slide-bar has a T-shaped longtitudinal groove 3. A mounting device 4, which is removably mountable on the molding 2 includes a member 5 forming an anchor-block, which is adapted to engage the groove 3 and has a complementary shape to the groove, and an outer member 6 forming an accessory fitting or being part of the accessory to be mounted. The lower surface 7 of the member 5 rests on the outer surface 8 of the profiled molding 2, on either side of the groove 3. For this purpose, the surfaces 7 and 8 have complementary shapes. The outer member 6 may be removably secured to the part forming the anchor-block 5 by appropriate means, for example nuts and bolts 10. Mounting is done by locking the two members 5 and 6 onto the profiled molding 2. The lip-profiled edges 11 of the groove 3 are preferably flexible to permit insertion of the anchor-block 5 into the groove in the desired position anywhere along the profiled molding 2. Thus an accessory may be removably mounted on the rubber boat 1.

It is pointed out that the shape of the outer members 6 should preferably be suited to the accessory onto which they must fit. FIGS. 2 and 3 show by way of example two accessory-fitting devices 6. The front surfaces of the member according to FIG. 2 have orifices 14 by which a grip or a lifting ring 15 may be locked on, as is shown in FIG. 1. The accessory-fitting device according to FIG. 3 is adapted as an oarlock and is equipped for this purpose with a journal-forming element 16. It may be seen that in this case the surfaces 7 and 8 in contact with the part 6 and with the profiled molding are flat.

Referring to FIGS. 4*a* to 8*a* and 4*b* to 8*b*, other alternative embodiments of the system according to the invention are described.

Figures 4A, 4B, 5A, 5B, 6A, 6B, 7A, 7B, 8A, 8B:
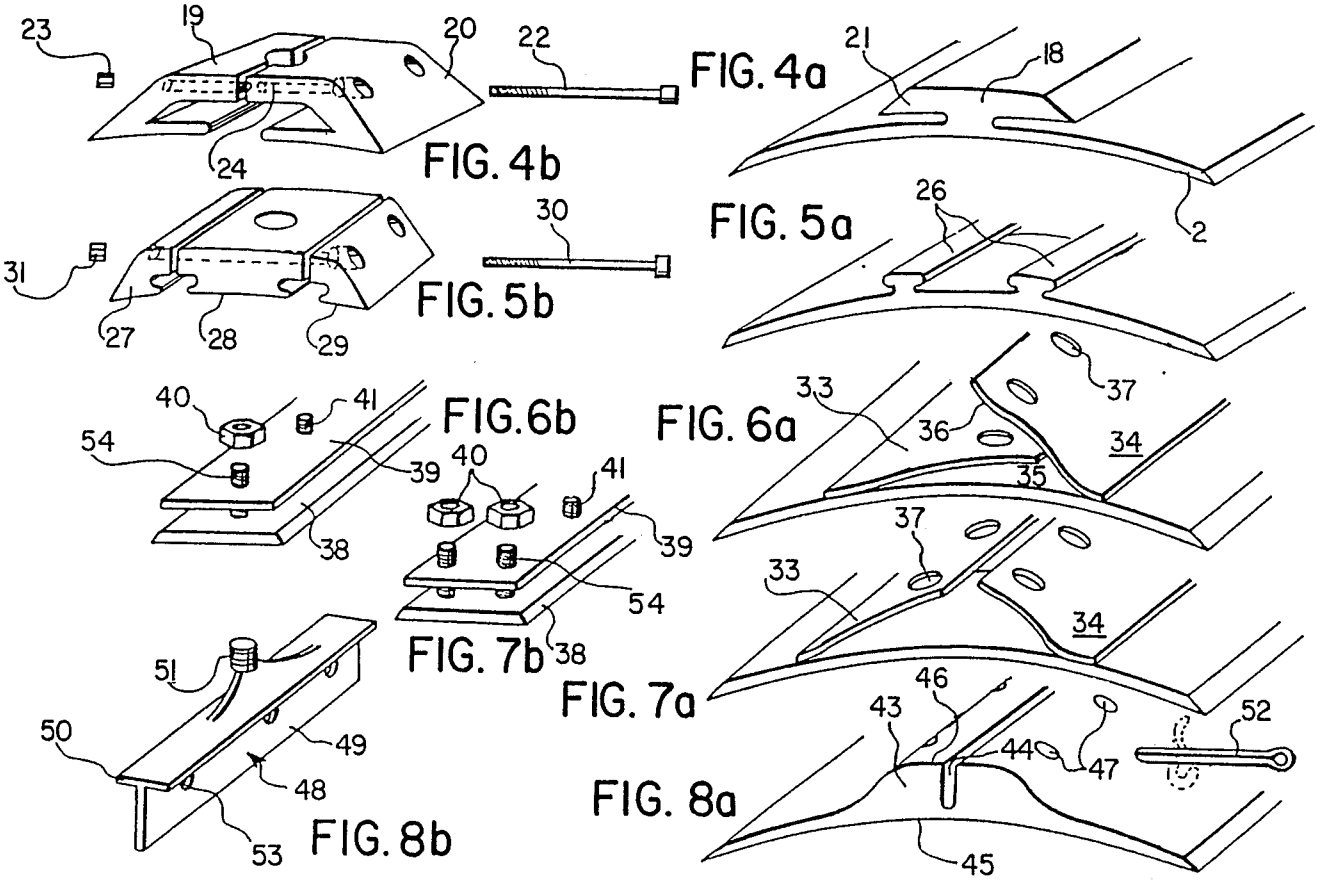

In the embodiment according to FIGS. 4*a* and 4*b*, the slide-bar element of the profiled molding 2 comprises a T-shaped rib 18. The detachable, adjustable device for mounting of an accessory on the profiled member 2 is illustrated in FIG. 4*b* and comprises two parts 19 and 20 which are symmetric in relation to the axis of the rib 18. These two members each lock onto one of the two branches 21 of the T-shaped rib 18. For this purpose, each member includes cavities which fit the shape of a branch 21. The two parts are assembled by means of bolts 22 and their nuts 23. To permit passage of the bolts 22, the members 19 and 20 have transverse holes 24. It is readily seen that when assembled, the two members 19 and 20, when in place on the rib 18, lock the anchor-block on the rib 18, by means of the nuts 23 screwed onto their bolts 22.

In the embodiment shown in FIGS. 5*a* and 5*b*, the profiled molding 2 shows two ribs 26 each having a T-shaped cross section. A part forming an anchor-block and which fits onto these ribs 26 is composed of three parts 27, 28, 29, which are assembled and removably locked on the ribs 26 through locking, as in the case of FIG. 4, by means of bolts 30 and nuts 31. This division of the anchor-block into three parts permits ready positioning of this member anywhere along the profiled molding 2. It should be pointed out that the two outer parts 27 and 29 correspond to members 19 and 20 in FIG. 4*b*, while the middle part 28 is adapted to lock onto the two ribs 26. In an alternative embodiment, the anchor-block shown in FIG. 5*b* is made of a single piece with the outer surface of the middle part 28 preferably being roughened or serrated, and preferably convex, such that it is mounted to engage the ribs 26 when the boat is partially deflated. Once the boat is fully inflated, the increased pressure on the surface 28 would ensure that the anchor-block is locked in place. For such an alternative embodiment, it is preferred that the profiled molding 2 be made in several shorter sections, such that the anchor-block need not be slid into position a long way from the edge, since an integral anchor-block cannot now be assembled at the desired position as in the case of the three part anchor-block shown in FIG. 5*b*.

The embodiments illustrated in FIGS. 6*a* to 7*a* and 6*b* to 7*b* are distinguished by the fact that the lateral walls 33 and 34 which define the cavity 35 of the profiled member are movable and flexible. In FIG. 6, the free edges 35 of the two walls 33 and 34 overlap, while in the embodiment according to FIG. 7, this overlapping does not occur. It may be seen that each longtitudinal edge of the walls 33 and 34 is provided at regular intervals with holes 37. The detachable mounting devices which fit onto these profiled moldings and which are illustrated in FIGS. 6*b* and 7*b* include a part forming an anchor-block 38 adapted to engage the cavity 35 of the profiled members. On its upper surface, this part 38 has a row (FIG. 6*b*) or two rows (FIG. 7*b*) of raised cylindrical elements 54 which can pass through the holes 37 in the lateral walls 33 and 34 of the profiled member to permit temporary mounting of a plate-profiled outer member 39, by locking against the lateral wall. This member is locked on by means of nuts 40 screwed onto the elements 54 which are threaded for this purpose. The outer member 39 is provided with accessory-fitting elements 40 or is an integral part of these accessories.

A profiled molding according to FIGS. 8*a* and 8*b* shows greater thickness in its longtitudinal median part 43, in which there is a slot 44 of a predetermined width and perpendicular to the surface 45, by which the profiled member is secured to the inflatable structure, which slot extends from the free surface 46 to a predetermined depth and, preferably at regular intervals in the longtitudinal direction of the moldings, holes 47 which pass through the area 46 in a transverse direction. A detachable device for mounting of an accessory on this profiled molding 2 is in the form of a member 48 having a T-shaped cross section of which the vertical part 49 is adapted to lock into the slot 44 of the profiled member while the upper surface of the cross bar 50 has an accessory-holding element 51. The member 48 may be locked into the slot 44 of the profiled molding using suitable bolts, such as for example split cylindrical bolts 52 adapted to pass through the transverse holes 47 of the profiled molding and the corresponding holes 53 in the accessory-fitting device 48.

By means of the profiled moldings which, if desired, may be secured permanently to the inflatable structure and the detachable accessory-fitting devices which may be locked onto these moldings, it is possible according to the invention to removably position accessories at any point along the profiled moldings. These latter may be of pliable, flexible material. The parts constituting the accessory-fitting devices may be constructed of appropriate rigid material. As regards the shapes of the moldings and the accessory-fitting devices, these are not limited to the embodiments described here by way of example.

What is claimed is:

1. A system for mounting accessories on inflatable structures such as boats, comprising: a profiled molding forming a strip adapted to be secured to the inflatable structure, and a selectively, removably securable, position-adjustable device adapted to engage and be secured to said profiled molding for mounting accessories and accessory-fittings thereon, wherein said profiled molding is in the form of a slide-bar having a T-shaped groove, said removable accessory-mounting device having an anchor-block member adapted to engage and be held in said groove, an outer member forming an accessory-fitting adapted to engage the outer surface of the molding on either side of the groove, and securing means for removably attaching the outer member to the anchor-block member, by securing the two members onto the molding.

2. The system according to claim 1, wherein said profiled molding is in the form of a slide-bar having at least one T-shaped rib, and wherein said removable accessory-mounting device has a member forming an accessory-fitting said member being an anchor-block adapted to removably engage said rib and being secured to same by securing means preferably of the bolt and nut type.

3. The system according to claim 2, said anchor-block comprising two components each of which is adapted to engage the rib on either side thereof and which are adapted to be assembled, while being mounted onto the rib, with suitable securing means such as threaded bolts inserted into cooperating holes in the two components.

4. The system according to claim 2, wherein the profiled molding has two paralled ribs and the anchor-block comprises three components permitting the engagement of said anchor-block and the profiled molding, and wherein assembly and securement of the anchor-block is by means such as bolts with nuts passing through the three components perpendicularly to the axis of the ribs.

5. A system for mounting accessories on inflatable structures such as boats, comprising: a profiled molding forming a strip adapted to be secured to the inflatable structure, and a selectively, removably securable, position-adjustable device adapted to engage and be secured to said profiled molding for mounting accessories and accessory-fittings thereon, wherein the molding has a concave profile of which the lateral walls form flaps, and a detachable accessory-mounting device has an anchor-block member between said flaps, and which is provided with protruding elements adapted to pass through orifices in said walls and an outer member forming an accessory-fitting and adapted to be removably attached to the anchor-block by means of said protruding elements so as to lock the two members against the walls of the molding.

6. The system according to claims 3, 4, or 5, wherein the profiled molding is made of a pliable, flexible material.

7. The system according to claims 3, 4 or 5, wherein the accessory-fitting device is removably mounted onto a profiled molding through deformation of appropriate parts of the molding.

* * * * *